United States Patent [19]

Haley

[11] 4,093,146

[45] June 6, 1978

[54] WINDING METHOD AND APPARATUS FOR STRAPPING AND STRAPPING PACKAGE

[75] Inventor: Harold A. Haley, Media, Pa.

[73] Assignee: FMC Corporation, Philadelphia, Pa.

[21] Appl. No.: 717,432

[22] Filed: Aug. 24, 1976

Related U.S. Application Data

[63] Continuation-in-part of Ser. No. 561,133, Mar. 24, 1975, abandoned.

[51] Int. Cl.[2] ..... B65H 54/28; B65H 55/04

[52] U.S. Cl. ..... 242/158.2; 242/158.4 R; 242/176

[58] Field of Search ..... 242/158.2, 158.4, 158 B, 242/DIG. 2, 177, 54 R

[56] References Cited

U.S. PATENT DOCUMENTS

| | | | |
|---|---|---|---|
| 2,912,187 | 11/1959 | Rau, Jr. | 242/158.4 |
| 3,257,087 | 6/1966 | Kriete et al. | 242/158.4 R |
| 3,272,454 | 9/1966 | Lane et al. | 242/117 |
| 3,312,421 | 4/1967 | Kerr et al. | 242/158.4 R |
| 3,520,494 | 7/1970 | Anderson et al. | 242/158 B |
| 3,610,549 | 10/1971 | Wennerstrom et al. | 242/117 |
| 3,829,037 | 8/1974 | Sallin | 242/158.2 |

*Primary Examiner*—George F. Mautz
*Attorney, Agent, or Firm*—Eugene G. Horsky

[57] ABSTRACT

Method and apparatus for winding continuous, flexible, strapping into rolls comprised of overlying layers, with each such wound layer having a like number of convolutions, including like strapping portions which bridge adjacent overlying layers and are subjected to a minimum of distortion, and a stable wound strapping package having a substantially round contour.

22 Claims, 7 Drawing Figures

WINDING METHOD AND APPARATUS FOR STRAPPING AND STRAPPING PACKAGE

CROSS REFERENCE

This application is a continuation-in-part of my U.S. patent application Ser. No. 561,133, filed Mar. 24, 1975 and now abandoned.

The present invention is directed to a method and apparatus for winding continuous, flexible, strapping into roll form and an improved strapping package.

The method and apparatus of this invention are adapted for use in winding into roll form a variety of continuous, flexible, elongated structures, such as cords, ropes, cables and bare or insulated wires. This invention is especially advantageous in winding of metallic and non-metallic (plastic, paper, cord, etc.) strapping which, as used herein, includes ribbons, tapes, bands, and other similar elongated, flexible structures having widths which are narrow and substantially greater than the thicknesses thereof, and which are especially difficult to wind in roll form without being subjected to significant distortion. Thus, to afford a good understanding and full appreciation of the merits of the present invention, the method and apparatus of this invention are hereafter described as employed in the winding of strapping, and particularly in satisfying the demanding requirements encountered in winding of molecularly oriented plastic strapping.

Strapping formed of thermoplastic polymeric materials, such as polypropylene, nylon and polyester, is pressure rolled or stretched to orient the molecules thereof predominantly in a direction longitudinally of the strapping. Such molecularly oriented plastic strapping, hereafter referred to as "plastic strapping" or "strapping", has a propensity to split in its longitudinal direction, particularly in the case of polypropylene strapping, and, being greater in width than in thickness, resists bending in its plane. Thus, winding of such strapping into a stable and attractive roll, with a minimum of distortion of the strapping, is indeed a demanding requirement.

More specifically, such strapping is wound in overlying layers, with each such layer being comprised of a series of strapping convolutions, including portions which bridge or connect overlying roll layers and define nodes at the opposite ends of the wound roll at which the direction of the strapping travel is reversed. The bridging portions of such strapping must be properly supported and effectively locked in place to prevent the same from being displaced or "pushed out" from the ends of the wound roll, and thereby disturb the roll appearance and stability, yet distortion of such bridging portions must be minimized.

The distortion of plastic strapping which is of most concern is that which is caused by bending of such strapping whereby one of its longitudinal edges is strained at the location of bending while the opposite longitudinal edge at such location is relaxed. In the wound roll, such distorted strapping portions, and more particularly, the relaxed or unstrained longitudinal edges along such portions, become set. When the strapping is subsequently unwound from the roll, the strapping edge portions which are set generally remain set, while the edge portions which were heretofore strained, now tend to relax. As a result, when such unwound strapping is laid flat, the strapping portions which were distorted during winding manifest themselves as curved or arcuate portions or sections. Along these curved strapping sections, the opposite longitudinal edges, of course, span arcs having different radii and, since such sections are from different locations within the wound roll, variations will exist as to their amplitude and frequency.

With plastic strapping having excessive curvature, considerable difficulty, excessive abrasion (dusting) and waste are encountered when attempting to use such strapping with packaging machines. These disadvantages are pronounced, for example, when such strapping is used with packaging or strapping machines in which an automatic sequence of machine operations is dependent upon the movement and/or position of the strapping. For example, the passage of strapping, having curved sections, along a packaging machine yoke which at least partially encircles an article which is to be strapped, if at all possible, may well be difficult and/or interrupted, resulting in "short feeds"; that is, with the strapping which is delivered being improperly directed or insufficient to properly encircle the article which is to be strapped.

Conventional winding machines for strapping are primarily designed to provide rolls of rigid dimensions between opposite ends thereof, with the number of strapping turns or convolutions comprising the respective layers in such roll being adjusted continuously to maintain the end-to-end dimension. More particularly, with such known winding apparatus the strapping is traversed concomitantly with the winding thereof. However, since the width of the roll being wound is restricted to a rather rigid dimension, the portions of the strapping which bridge overlying roll layers are subjected to considerable distortion and, also, define nodes which are inadequately supported. Thus, such wound roll not only lacks stability but, when unwound, the distorted strapping portions manifest themselves as sections having excessive curvature.

A typical conventional winding apparatus may well include a traversing mechanism having a rather bulky strapping guide which engages with and is reciprocated along a linear path by a rotating barrel cam. Since such barrel cam is designed to provide for precise traversing of the strapping as it is wound into a roll of rather fixed dimensions, distortion of the strapping, as heretofore described, is likely. Moreover, wear along the cam and/or guide surfaces of such known traversing mechanism progressively changes the winding pattern and may aggrevate what is initially a poor winding system for strapping. Barrel cam replacements can be made, and indeed are required when different winding patterns are desired, but such changes are made only with difficulty and, for reasons as heretofore given, may not provide any significant benefit. Accordingly, a primary object is to provide a generally new or improved and more satisfactory method and apparatus for winding continuous strapping into roll form and the provision of a wound strapping roll having improved stability and appearance.

Another object of this invention is the provision of an improved method and apparatus for winding of continuous strapping into attractive and stable rolls in which transverse deformation and longitudinal distortion of the strapping is minimized.

Still another object is to provide an improved method and apparatus for winding continuous strapping into rolls comprised of overlying layers each having a like number of strapping convolutions.

A further object is the provision of an improved winding method and apparatus in which non-overlapping convolutions of continuous strapping are formed into overlying roll layers, with like strapping portions which bridge overlying layers being properly supported to avoid displacement thereof from the roll ends.

Yet another object of this invention is to provide an apparatus for winding strapping into a stable roll form in which the winding pattern, including such characteristics as the roll width and diameter and the length and orientation of the strapping portions which bridge overlying roll layers, can be easily and precisely adjusted to and maintained within desired limits.

A still further object of this invention is the provision of a strapping winding apparatus in which the number of moving parts, and thus the opportunity for wear to occur between contacting parts, is minimized.

A still further object of this invention is to provide an apparatus for winding strapping which can be easily and rapidly adjusted to accommodate strapping of different widths.

These and other objects are accomplished in accordance with the present invention by a method and apparatus for winding a continuous strapping as a roll comprised of a plurality of overlying layers each having a like number of strapping convolutions.

In the method of the present invention, the strapping is advanced continuously toward and onto a continuously rotating shaft where it is wound as a roll. It will be understood that the strapping is usually, but not necessarily, wound onto a flangeless core which is supported on the winding shaft so as to rotate therewith. Thus, during winding, and in the resulting wound roll, the opposite ends of the roll are exposed and the strapping convolutions thereat are not supported by any means external of such roll. A like number of electrical pulses are generated during each revolution of the winding shaft and a related train of electrical pulses is employed for moving a strapping traverse carriage linearly in one of opposite traverse directions relative to the rotating shaft during which I + F convolutions of strapping are wound about the shaft as a roll layer, where I is an interger and F ranges from zero to less than one complete convolution.

Alternately with the movement of the strapping in the opposite directions of traverse, the traverse carriage is maintained in dwell position for such period that a selected number of electrical pulses are generated by the winding shaft. All of the dwell periods are of like duration during which strapping convolution portions B are wound on the roll which bridge overlying roll layers. Since the winding of the strapping before and after a period of dwell is along opposite directions, the bridging portions are forced to assume an arcuate path. At the opposite ends of the wound roll, the exposed, curved edges of the bridging portions appear as nodes. Overlying of such nodes extending along a generally radial or spiral path, are hereafter referred to as a "group of nodes" or "node group".

The duration during which the carriage is maintained in dwell position is such that the strapping convolution portions F and B together range from essentially 1 minus $\frac{7}{8}$ or $1 - \frac{7}{8}$ of a strapping convolution to 1 plus $\frac{7}{8}$ or $1 + \frac{7}{8}$ strapping convolutions and the nodes defined by the bridging portions B at the respective ends of the wound roll are arranged in not less than two and not more than four groups of nodes. In the above limitation, the terminology "essentially 1 minus $\frac{7}{8}$ or $1 - \frac{7}{8}$ of a strapping convolution to 1 plus $\frac{7}{8}$ or $1 + \frac{7}{8}$ strapping convolutions includes exactly or substantially the fractions $\frac{1}{8}$, 1/6, $\frac{1}{4}$, $\frac{1}{3}$, $\frac{3}{8}$, $\frac{5}{8}$, $\frac{2}{3}$, 5/6, $\frac{3}{4}$and $\frac{7}{8}$ of a strapping convolution as well as each of these fractions of a convolution taken with a complete strapping convolution. The sum of the strapping portions F and B, whether being equal to one of the indicated fractions of a strapping convolution or to a complete strapping convolution plus such one fraction of a convolution, will result in wound rolls having like arrangements of node groups. Thus, the respective strapping portions F and B may be, for example, 0 and $\frac{3}{8}$, $\frac{1}{8}$ and $\frac{1}{4}$ or $\frac{7}{8}$ and $\frac{1}{2}$ convolution, so as to total $\frac{3}{8}$ of a strapping convolution or $1\frac{3}{8}$ convolutions, and in all these instances the resulting wound rolls will have the same arrangement of node groups. To avoid overlapping of adjacent strapping convolutions, the rate of carriage movement in each of its directions of traverse is not less than the width of the strapping being wound per revolution of the winding shaft. Preferably, the advancing strapping is traversed at a rate slightly greater than its specified width to insure that width variations which may be present are readily accommodated without any overlapping along adjacent strapping turns.

As noted above, the reversal in the direction of travel as the winding of one roll layer is completed and the winding of an overlying layer is commenced, causes the strapping portion bridging these layers to assume an arcuate path. Stresses along this curved bridging portion thus tend to push or pivot the bridging portion outwardly from the roll end and into an equilibrium condition.

The radius of curvature of this bridging portion will vary with its length which, of course, is dependent upon the period of dwell. More specifically, as the period of dwell is decreased, the locations of inflection; that is, the locations between which the bridging portion bends, are moved closer to each other and the radius of curvature of such bridging portion decreases. Of course, the opposite effect is provided as the period of dwell is increased. While minimizing the radius of curvature of such bridging portion provides for good roll stability, such bridging portion, when unwound, may exhibit an undesirable degree of curvature. On the other hand, an increase in the radius of curvature of such bridging portion will reduce the degree of curvature exhibited by the strapping when it is unwound, but involves a sacrifice in the support of such portion and thus provides a wound roll of less stability.

Obviously, the period of dwell employed will vary with the degree of curvature which can be tolerated in the intended application of such strapping. For example, hand-operated strapping tools may perform well with strapping having such curvature as would render it unsuitable for use with automatic strapping machines. Thus, for the sake of good roll stability, it is preferred that the period of dwell employed not exceed that which imparts only such curvature to the bridging portions as is not objectionable, as distinguished from excessive, in the particular application for which such strapping is intended.

Obviously, strapping as well as a ribbon, tape, band, and the like, exhibits some degree of stiffness or rigidity, and thus, it is physically impossible to effect an immediate reversal in the traversing of such strapping; that is, a zero dwell of the strapping after it has been traversed in each of its opposite directions. Thus, although the apparatus employed may be such as to provide for essentially no intentional dwell, the strapping stiffness causes the strapping portions which bridge overlying roll layers to assume such arcuate path; that is, define nodes as they would if such strapping was, in fact, subjected to some intentional minimum dwell period. Accordingly, reference made herein to "minimum dwell" includes that intentional dwell which would influence the bridging portions of the strapping into the same arcuate contour as is dictated by the strapping stiffness.

Equally obvious is that the minimum dwell will differ with plastic strapping of different stiffness which, in turn, may well vary with such factors as the strapping material, the width-to-thickness ratio, the degree of molecular orientation and the ratio of longitudinal to transverse molecular orientation.

For example, the minimum dwell period required with smooth polypropylene strapping, which has been molecularly oriented by longitudinal stretching to a ratio of about 8:1 and having a $\frac{3}{8}$ inches width and 20 mil thickness, is not greater than about 0.1 turn of the winding shaft. In other words, during about 0.1 of a revolution of the winding shaft, a like portion (i.e. about 0.1) of a convolution of a non-traversing polypropylene strapping will be wound onto the roll as a bridging portions which defines a node generally equivalent to that as would be dictated by the strapping stiffness if no intentional dwell was provided.

In one preferred mode of practicing the method of the present invention, the carriage is maintained in dwell position for such duration that the strapping portions F and B are together equal to $\frac{1}{4}$ or $\frac{3}{4}$ of a strapping convolution or $1\frac{1}{4}$ or $1\frac{3}{4}$ strapping convolutions, whereby the overlying nodes at the respective roll ends are arranged into only two groups of nodes which together extend diametrically of the roll end. In the resulting strapping roll, the curvature of the bridging portions is not excessive. Moreover, nodes in each group of nodes are separated by only a single thickness of strapping, which is not part of any bridging portion, and thus each of the bridging portions is properly and snugly supported within the wound roll.

In another preferred mode of practicing the method of the present invention, the carriage is maintained in dwell position for such duration that the strapping portions F and B are together equal to $\frac{1}{3}$ or $\frac{2}{3}$ of a strapping convolution or $1\frac{1}{3}$ or $1\frac{2}{3}$ strapping convolutions whereby the overlying nodes at the respective roll ends are arranged into only three equally spaced, groups of nodes, with the nodes of each of such groups lying along a spiral path. This winding mode is particularly suited for use with strapping of narrow width, for example, less than about 5/16 inch, which has a tendency to "shell"; that is, be easily displaced from the roll ends, when wound as a roll having two node groups at each end. In the resulting roll the curvature of the bridging portions of strapping, particularly narrow width strapping, is not excessive. Further successive nodes in each group of nodes are separated by only two thicknesses of strapping, neither of which is part of a bridging portion, which provide adequate support of the bridging portions and thus good roll stability.

In accordance with the method of the present invention strapping may be wound into rolls in which the strapping portions F and B are together equal to $\frac{1}{8}$, $\frac{3}{8}$, $\frac{5}{8}$ or $\frac{7}{8}$ of a convolution as well as $1\frac{1}{8}$, $1\frac{3}{8}$, $1\frac{5}{8}$, or $1\frac{7}{8}$ strapping convolutions, whereby the wound rolls have four node groups at each end thereof, and also into wound rolls in which the strapping portions F and B are together equal to essentially 1/6 or 5/6 of a convolution as well as 1 1/6 or 1 5/6 strapping convolutions, whereby three node groups are formed at each end of the resulting rolls.

A wound strapping roll having a single node group at each end thereof, in which case the strapping portions F and B are together equal to $\frac{1}{2}$ or 1 convolution or $1\frac{1}{2}$ convolutions, is unsatisfactory. In this instance, the successive bridging portions B at the respective roll ends directly overlie each other and are inadequately supported so that roll stability is extremely poor. Strapping rolls having more than four node groups at each end thereof are also unsatisfactory and also because of roll instability. For example, if strapping is wound into a roll in which portions F and B are together equal to 3/7 of a convolution or 1 3/7 convolutions, seven node groups would be formed at each roll end. In this instance, the large number of strapping thicknesses separating the successive nodes in each node group provides for inadequate support of the bridging portions of strapping and thus poor roll stability.

As noted above and hereafter discussed more fully, in the method of the present invention, a like number of electrical pulses are generated during each revolution of the winding shaft and a related train of electrical pulses is employed for moving the traverse carriage linearly in one of its opposite directions of traverse. Alternately with the movement of the carriage in the opposite directions of traverse, the carriage is maintained in a dwell position for a period during which a selected number of electrical pulses are generated by the continuously rotating winding shaft. Thus, it will be apparent that both the traversing movement as well as the periods of dwell are correlated with the rotation of the winding shaft.

The apparatus of the present invention provides for a necessary precise and consistent winding pattern, yet can be easily and rapidly adjusted for use with strapping of various widths. As with conventional strapping winding machines, the apparatus of the present invention includes a rotatable winding shaft on which either a flanged or flangeless roll core is supported for rotation therewith, a drive means for continuously rotating such shaft and a traverse mechanism consisting of a traverse or lead screw and a carriage having a strapping guide; that is, means for laying the strapping onto the roll which is being wound. This traversing mechanism cooperates with the winding shaft to coil a continuous, longitudinally advancing strapping onto such shaft as a roll comprised of overlying strapping layers.

Of particular significance is the use in the apparatus of the present invention of a highly refined and reliable traverse mechanism and a precision drive system for such traverse mechanism which is electronically correlated with the rotation of the winding shaft. As will be more apparent hereafter, while the drive system for this traverse mechanism is controlled by the rotary movement of the winding shaft, it is driven by means independent of that employed in driving such winding shaft.

Basically, the traverse mechanism drive system includes a stepping motor having an output shaft which effects rotation of the lead screw and thus the movement of the traverse carriage, means for generating a like number of electrical pulses during each revolution of the winding shaft, electronic means for transmitting a related train of electrical pulses or stepping signals to such stepping motor at like spaced intervals to rotate the stepping motor shaft sequentially in opposite directions, and a change gear system for regulating the rate at which the output shaft of the stepping motor drives the lead screw.

More specifically, in the preferred embodiment of the apparatus, the means for generating a like number of electrical pulses during each revolution of the winding shaft is an encoder, hereafter referred to as a primary encoder. The means for transmitting a related train of electrical pulses to the stepping motor also includes an encoder, hereafter referred to as a secondary encoder, one or more electronic counters, a latching reverse relay and a translator.

Optical encoders, such as manufactured by Encoder Products Company, have been found to be satisfactory as both primary and secondary encoders in the apparatus of the present invention. Such encoder simply consists of a rotatable disc, which is positioned between a lamp and a light sensor, and includes alternate clear and precise opaque segments. Thus, as the encoder disc is rotated, the light sensor is intermittently activated with its signals being converted by an internal squaring circuit into square wave output pulses; that is, voltages which fluctuate between two definitive values, one while the sensor light circuit is activated and the other when the sensor is shielded by an opaque segment of rotating disc. The encoder signal output per each revolution of the encoder disc is, of course, determined by its number of clear segments.

In the apparatus of this invention, the disc of the primary encoder is rotated by the winding shaft and, in turn, serves to rotate a like disc of the secondary encoder through the change gear system. Thus, during rotation of the respective discs the number of electric pulses generated by the two encoders are related.

The electrical pulses generated by the secondary encoder are transmitted through the translator to the stepping motor, while the electronic counter receives the electric pulses generated by the primary encoder. As more fully described hereafter, the electronic counter periodically interrupts the flow of electric pulses which are transmitted from the secondary encoder to the translator and thus the stepping motor receives, as stepping signals, spaced trains of electric pulses.

With each such train of stepping signals, the stepping motor rotates the lead screw and advances the traverse carriage in one direction of its reciprocation during which I + F convolutions of strapping are wound about the winding shaft. During the interruption or interval between successive trains of such stepping signals, the stepping motor, of course, is inoperative, the carriage is in a dwell position and a bridging portion B of strapping is wound on the roll. The duration of such interruption is such that the strapping portions F and B together range from $1 - \frac{7}{8}$ of a strapping convolution to $1 + \frac{7}{8}$ convolutions and from not less than two and not more than four groups of nodes are formed at each end of the wound roll.

The electronic counter also serves to actuate the latching relay which is interposed between such counter and the translator. This relay directs the interrupted flow of electric pulses from the secondary encoder alternately to different input terminals of the translator to provide for alternate clockwise and counterclockwise rotation of the stepping motor.

Employed in the apparatus of this invention are either two electronic counters, or a single electronic counter having two preset count levels, with each preset count level, hereafter referred to as "preset", being stimulated by a predetermined count or number of electrical impulses from the primary encoder. When using two electronic counters each is "preset" for a predetermined number of counts so that such two counters function and are equivalent to a single counter having two presets. For the sake of simplicity, the apparatus is hereafter described as using a single electronic counter having two preset count levels, with each preset, as the term implies, being set or adjusted for a specific number of counts, one for interrupting the flow of electric pulses from the secondary encoder, to maintain the stepping motor and, of course, the traverse mechanism, quiescent during a selected number of counts, and the second permitting such flow of electric pulses from the secondary encoder to the translator and the stepping motor during a desired number of counts.

More specifically, with the rotation of the winding shaft and the disc of the primary encoder at a 1 to 1 ratio, the number of electric pulses generated by such encoder during each revolution of the winding shaft is multiplied by I + F, the number of convolutions desired in each roll layer, to determine the count entered into the second preset of the electronic counter. Likewise, the number of electric pulses generated by this primary encoder during the winding of a bridging portion B of strapping, such that F + B ranges from $1 - \frac{7}{8}$ of a convolution to $1 + \frac{7}{8}$ convolutions, is entered into the first preset of the electronic counter.

The electrical pulses received from the secondary encoder, as is permitted by the second preset of the counter, are converted by the translator into the switching sequence of stepping signals needed to drive the stepping motor. More specifically, for each electrical impulse received, the translator will deliver to the stepping motor one stepping signal which will drive such motor through one step. Since the number of stepping signals in each such train of signals is critical for satisfactory operation of the apparatus, and since the translator itself cannot count, the counter is certainly an essential element of this apparatus.

Electronic counters are ordinary items of commerce and are admirably suited for use in the apparatus here described because of their rapid operation and absence of inertial loads. Suitable translators are also readily available from a number of sources, as for example, The Superior Electric Company of Bristol, Connecticut.

As heretofore mentioned, overlapping of adjacent convolutions of strapping in any of the roll layers tends to distort such strapping and, preferably, is avoided. Thus, the traverse carriage must be advanced along the lead screw a linear distance at least equal to the specified width of the particular strapping which is being wound during each rotation of the winding shaft. Preferably, the traverse carriage advancement during each rotation of the winding shaft is slightly greater than the specified width of the strapping which is being wound to accommodate for small variations in the width of such strapping, and thus adjacent strapping convolutions may well be spaced from each other throughout the roll which is formed. Since the rate of carriage travel will vary directly with the strapping width, the gears of the change gear system will also be varied to provide for rotation of the lead screw and carriage travel at a rate which will accommodate the width of a particular strapping which is to be wound.

In the traverse mechanism of the apparatus of the present invention, suitable bearings support the lead screw for rotary movement about its axis, with such lead screw being disposed substantially parallel to the winding shaft and connected directly to the output shaft of the stepping motor.

To secure precise operation of the traverse mechanism, the friction level of such traverse mechanism is minimized by employing a ball bearing traverse screw and nut arrangement, with the nut forming part of the carriage. In such arrangement the screw thread defines a race for a series of ball bearings circulating in a similar race formed in the nut. This series of ball bearings is held captive and, after travelling along the nut race, the ball bearings are passed from one end thereof to the other by one or more return tubes. Since the ball bearings provide the only physical contact between the traverse screw and nut, only a free rolling motion of the traverse carriage is involved when the screw is turned. The traverse carriage is guided also by suitable means to prevent its rotation relative to the traverse screw as it is turned.

In the apparatus of the present invention full advantage is made of the many desirable characteristics of known stepping motors, such as the precise response to command, favorable speed-to-torque and torque-to-inertia ratios and, since bearings and output shafts are the only mechanical connections involved, their high reliability. When employing a permanent magnet direct current stepping motor, its small residual torque serves well in holding the motor output shaft in a fixed position when the motor is not energized; that is, during the interruptions between the trains of stepping signals.

While stepping motors having a 0.9° step angle have performed well in the apparatus of the present invention, motors having other step angles, such as 1.8°, 2.5°, 5° and 15°, alone or in combination with divider circuits, may also be used without departing from the teachings of the present invention. Stepping motors which are suitable for use in the apparatus of the present invention are readily available from a number of sources, as for example, The Superior Electric Company, heretofore mentioned and Sigma Instruments, Inc. of Braintree, Mass.

In the preferred embodiment of the apparatus described above, the system of change gears interconnects the rotary discs of the primary and secondary encoders and the output shaft of the stepping motor is coupled directly to the traverse screw. With this arrangement the change gears maintain their same direction of travel throughout the winding operation, the traverse carriage is highly responsive to the drive of the stepping motor so that a consistent winding pattern is maintained, and the frictional load and, more importantly, the inertial load to which stepping motor systems are particularly sensitive, are minimized. Further, it will be noted that varying the ratio of the change gears has no effect upon the counts set into the presets of the electronic counter.

Conventional procedures are employed in the design of the change gear system, taking into account such considerations as the pitch of the lead screw, the width of the strapping to be wound and the desired spacing beteeen adjacent strapping convolutions.

The preferred embodiment of the apparatus described above may be modified by eliminating the secondary encoder, with the signals generated by the primary encoder being employed to drive the stepping motor. The change gear system may be interposed between the winding shaft and the primary encoder, which requires new counts to be set into the counter presets when the change gear ratio is varied, or between the output shaft of the stepping motor and lead screw, which would require such gears to change their direction of travel with each reversal of the stepping motor. While both of these modifications provide satisfactory results, more precise results and ease of operation are achieved with the preferred embodiment of the apparatus which was first described.

In the wound rolls of the present invention, 2, 3 or 4 node groups will appear at the opposite ends of the respective rolls. For example, if the described apparatus employs a primary encoder which generates 400 electrical pulses per revolution of its disc, winding of strapping with portions F and B which are together equal to $\frac{1}{4}$ or $\frac{3}{4}$ of a convolution or $1\frac{1}{4}$ or $1\frac{3}{4}$ convolutions will result in rolls having two radially extending node groups at each end thereof. On the other hand, winding of strapping with portions F and B which are together equal to $\frac{1}{8}$, $\frac{3}{8}$, $\frac{5}{8}$ or $\frac{7}{8}$ of a convolution or $1\frac{1}{8}$, $1\frac{3}{8}$, $1\frac{5}{8}$ or $1\frac{7}{8}$ convolutions will provide for rolls having four radially extending node groups at each end thereof. In the rolls having two node groups, such groups are in diametrical relationship, while in rolls having four such node groups, pairs of node groups are arranged diametrically and are offset 90° relative to the remaining like pair of node groups.

When winding of strapping portions F and B which are together equal to essentially 1/6, $\frac{1}{3}$, $\frac{2}{3}$ or 5/6 of a convolution or 1 1/6, $1\frac{1}{3}$, $1\frac{2}{3}$ or 1 5/6 strapping convolutions, three node groups will be formed at each end of the resulting roll. The winding of such fractional portions of strapping with apparatus employing a primary encoder which generates, for example, 400 electrical pulses per revolution of its disc would require a fraction of a count to be set into one of the presets of the electronic counter. Since this is, of course, not possible, the count of such one preset is either increased or decreased to provide for a whole number of counts, with the other of such counter presets, which already has a whole number of counts being unchanged. Thus, if the winding of a desired bridging portion of strapping B requires a whole number of counts and the winding of the strapping I + F requires a whole number of counts plus a fractional portion of a single count, the latter count is either reduced by such fractional portion of a count, thereby slightly reducing the travel of the traverse carriage, or is increased to the next full count, thereby slightly increasing the travel of the traverse carriage. In this instance, no change is made in the whole number of counts required to provide the desired bridging portion B of strapping.

Obviously, entering a whole number of counts into both presets of the electronic counter, as explained above, provides for a change, but an extremely small change in the length of travel of the traverse carriage. For example, when using a 0.9° step angle stepping motor, changing one of the presets by a fractional portion of a count involves a change in the traverse carriage travel which obviously is less than that provided by rotation of the stepping motor output shaft through a 0.9° angle.

As a result, when winding of rolls in which F + B are together equal to essentially 1/6, $\frac{1}{3}$, $\frac{2}{3}$ or 5/6 of a convolution or 1 1/6, $1\frac{1}{3}$, $1\frac{2}{3}$, or 1 5/6 strapping convolutions, three node groups are formed at the opposite ends of such wound roll, but successive nodes in such group of nodes are displaced a slight distance circumferentially relative to an immediately preceding node. The nodes of each of such groups, instead of lying along a radius of a roll end, are disposed along a portion of a spiral path. The direction of this path relative to the roll axis is not significant and depends upon whether the count of a counter preset has been increased or decreased to provide for a whole number of counts.

Employing a primary encoder which generates a number of electrical pulses, other than 400, may well avoid or further minimize the spiral arrangement of nodes. For example, in winding a roll in which a complete number of strapping convolutions are wound in each layer (I + F, where F is zero), by using a primary encoder which generates 300 electrical pulses per revolution a bridging portion of strapping B equal to ⅓ of a convolution could be achieved by entering a count of 100 in counter preset which control the period of carriage dwell.

With rolls having an even number of node groups at each end thereof, it will be apparent that the successive nodes of each such group cause the ends of the resulting wound roll to be of slightly larger dimensions along lines coincident with the respective diametrically disposed groups of nodes. While depending upon the strapping thickness and number of overlying layers of strapping wound in such roll, the non-circular contour of the ends of such wound strapping roll generally escapes notice and is of no apparent detriment to the utility of the strapping or the performance of the machine in which such strapping is employed. However, the existence of such non-circular roll ends may detract slightly from the otherwise good roll appearance, increase the overall size of the wound roll, provide for uneven hoop tensions which may aggrevate roll core crushing problems in the event the wound roll is subject to conditions under which the strapping shrinks, cause non-uniform unwinding of strapping and, if the traverse carriage guide engages with the roll during winding, such guide may well be subjected to vibrations which may have a detrimental effect upon its operation and perhaps damage the same.

Accordingly, it may be desirable that successive nodes of each such group of nodes be intentionally displaced from each other circumferentially. This objective is readily achieved by either slightly increasing or decreasing either the length of the strapping traversing movement or the period of dwell, preferably by only a single step and not more than 2 or 3 pulses, yet maintain the length of each of such traversing movements and the duration of the periods of dwell consistent throughout the winding operation. In this manner, the successive nodes of the respective groups of nodes are displaced circumferentially in the same direction with each such node still overlying essentially all of an immediately preceding node in the same group. As heretofore explained, the direction of node displacement may be either clockwise or counterclockwise about the roll axis, depending on whether the length of the traverse movement has been increased or decreased, or conversely, whether the duration of the dwell period has been slightly decreased or increased. When viewing the end of a roll of strapping wound in this way, the nodes of the respective groups of nodes lie along a spiral path extending from near its roll core toward the roll periphery.

For a still better understanding and appreciation of the present invention, reference is made to the following detailed description of a preferred embodiment of the method and apparatus and the accompanying drawing, in which, FIG. 1 is a side view of the apparatus of the present invention, with portions thereof shown in section and with certain of the elements thereof illustrated schematically;

Certain of the elements of the apparatus of the present invention are similar to those employed in conventional strapping winding systems and, for the sake of simplicity, are not described nor illustrated in detail. In this respect, and shown in FIG. 1, the apparatus includes a conventional core-receiving mandrel 9 mounted on a winding shaft 11 which is supported for rotary movement by a fixed frame structure 13 and, as best shown in FIG. 2, one end of such shaft 11 is free to permit a flangless roll core 15 to be moved axially onto or from the mandrel 9.

Figure 1:
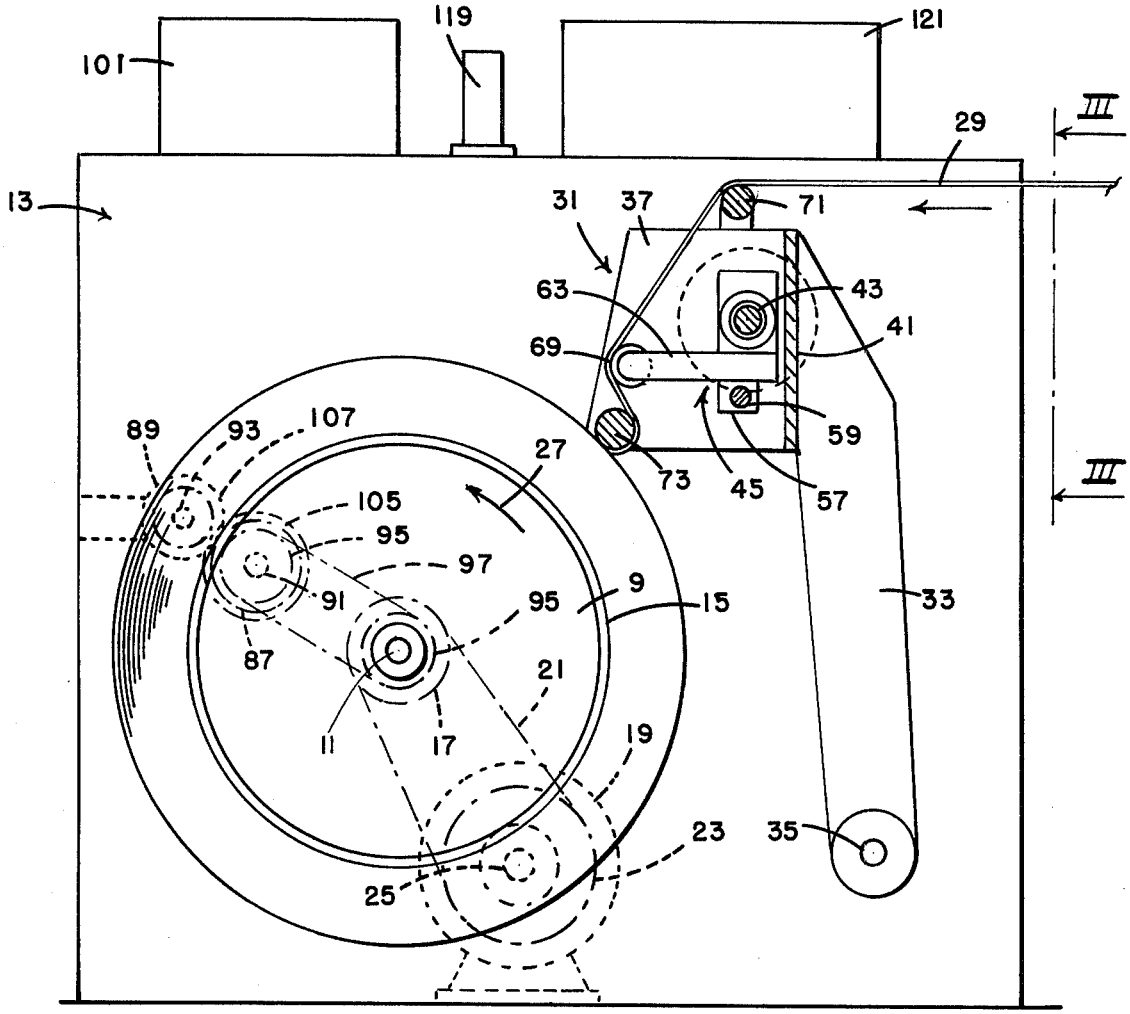
Figure 2:
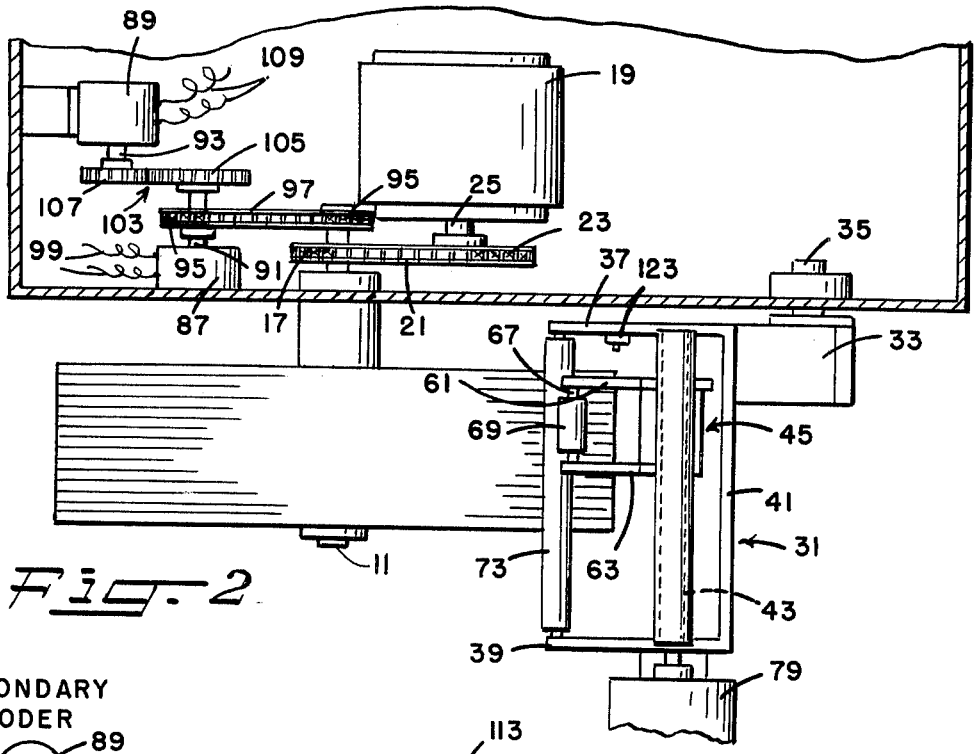
FIG. 2 is a plan view of a portion of the apparatus illustrated in FIG. 1, with a part of such apparatus being shown in section.

Again as viewed in FIG. 2, a sprocket 17 is fixed to the remote end of the winding shaft 11 and is driven by an electric motor 19 through a timing chain 21 trained over such sprocket 17 and a sprocket 23 fixed to the motor output shaft 25. The rotation of the output shaft of the motor 19 is in only one direction during the winding operation to rotate the roll core 15 in a direction as indicated in FIG. 1 by the arrow 27.

Strapping 29 delivered from a production or other source, not shown, is wound onto the core 15 as the winding shaft 11 is driven by the motor 19, with the convolutions of wound strapping being laid in desired relationship by a traverse mechanism, designated generally by the character 31. This traverse mechanism 31 is carried at one end of a lever 33 which is pivotally supported by a shaft 35 fixed to and projecting from the frame structure 13. As seen in FIG. 1, the weight of the traverse mechanism exerts a torque on the lever 33 urging the same in a counterclockwise direction toward the winding shaft 11 and, if desired, resilient means may also be provided to assist in this movement.

The traverse mechanism 31, includes a housing which is fixed to the lever 33 and simply consists of a pair of spaced end plates 37 and 39 and cross plate 41. A traverse or lead screw 43 extends between and is rotatably supported by the housing side plates 37 and 39, with its axis substantially parallel to that of the winding shaft 11.

Figure 4:
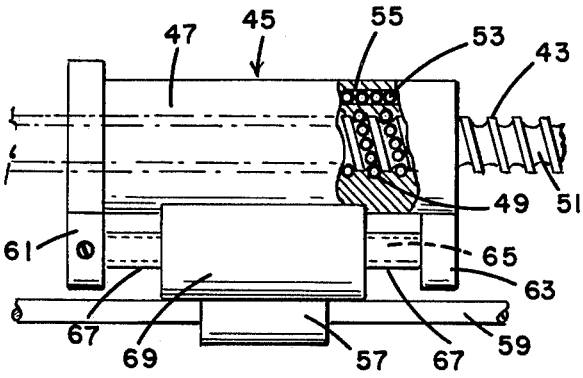
FIG. 4 illustrates a portion of the structure shown in FIG. 3 on an enlarged scale and with a portion thereof in section.
Figure 3:
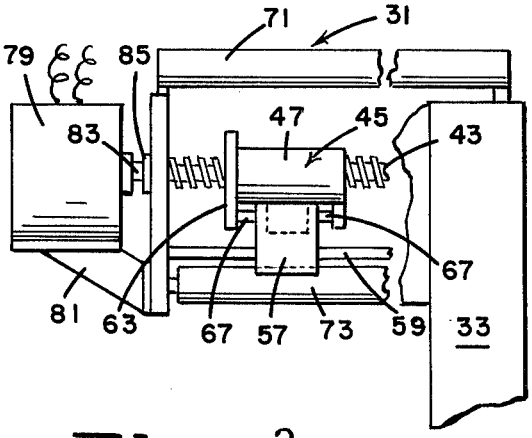
FIG. 3 illustrates a broken end view of the apparatus of the present invention as viewed in direction of arrows III—III of FIG. 1.

Mounted for movement along the lead screw 43 is a carriage 45 which, at best shown in FIGS. 3 and 4, includes a conventional ball nut 47 having an internal spiral groove 49 which serves as a race, as does the groove 51 on the lead screw 43, for a series of ball bearings 53. A passage 55 within the nut 47 connects with the opposite ends of the groove 49 and, together with the races described, defines an endless path for the ball bearings. Thus, as the lead screw 43 is turned, the ball bearings 53 travel along the endless path, thereby converting the rotary movement of the lead screw 43 to a linear movement of the ball nut 47.

Rotation of the carriage 45 about the lead screw 43 is prevented by a lug 57 which is suitably aperatured for sliding movement along a guide rod 59. This rod 59 is fixed at its ends to the housing side plates 37 and 39 with its axis substantially parallel to the axis of the lead screw 43 to insure free movement of the carriage 45. As heretofore mentioned, the ball bearings 53 provide for a free rolling motion and thus friction and wear of the moving parts are minimized.

Included also as part of the carriage 45 are generally parallel arms 61 and 63 which are each fixed at one end thereof to the ball nut 47. A shaft 65 extends through the free ends of such arms 61 and 63 and, together with spacers 67, rotatably support an idler roller 69. Supported also between the housing side plates 37 and 39 are rollers 71 and 73.

As shown in FIG. 1, strapping 29 is drawn from a supply source, not shown, guided by the roller 71 to the roller 69 where its direction of travel is reversed, and then laced about the roller 73 which is engaged with the periphery of the roll of strapping which is being wound. The roller 73 is maintained engaged with the strapping roll which is undergoing winding by the torque acting on the lever 33 and serves to lay the strapping 29 onto the periphery of such roll.

In this specific apparatus, and as shown in FIG. 3, a permanent magnet D.C. stepping motor 79 is employed and is supported from the housing of the traverse mechanism 31 by a bracket 81. The output shaft 83 of the motor 79 is coupled at 85 directly to the lead screw 43. Operation of the stepping motor 79 is controlled by the rotation of the winding shaft 11 through an electronic system which is diagrammatically illustrated in FIG. 5. While the individual units of this electronic system are commercially available, the use of the stepping motor 79 and the particular cooperation between these units and such stepping motor clearly distinguishes the apparatus and method of the present invention from those heretofore known.

Referring again to FIG. 2, reference characters 87 and 89 designate like primary and secondary optical encoders, each of which includes a lamp and a light sensor between which is positioned a disc carried by rotatable shafts, the latter of which are indicated at 91 and 93, respectively. Fixed to the winding shaft 11 and the shaft 91 of the primary encoder 87 are like gears 95 (1 to 1 gear ratio) over which is trained an endless chain 97. The disc of the primary encoder is thus rotated through one revolution with each turn of the winding shaft 11 with the output signals from such primary encoder being transmitted by wires 99 to an electronic counter 101 (see FIG. 5).

A change gear system is indicated at 103 and includes a drive gear 105 fixed to the shaft 91 of the primary encoder 87 and a driven gear 107 fixed to the shaft 93 of the secondary encoder 89. The output signals from this secondary encoder 89 are transmitted through wires 109 to the stepping motor 79.

Figure 5:
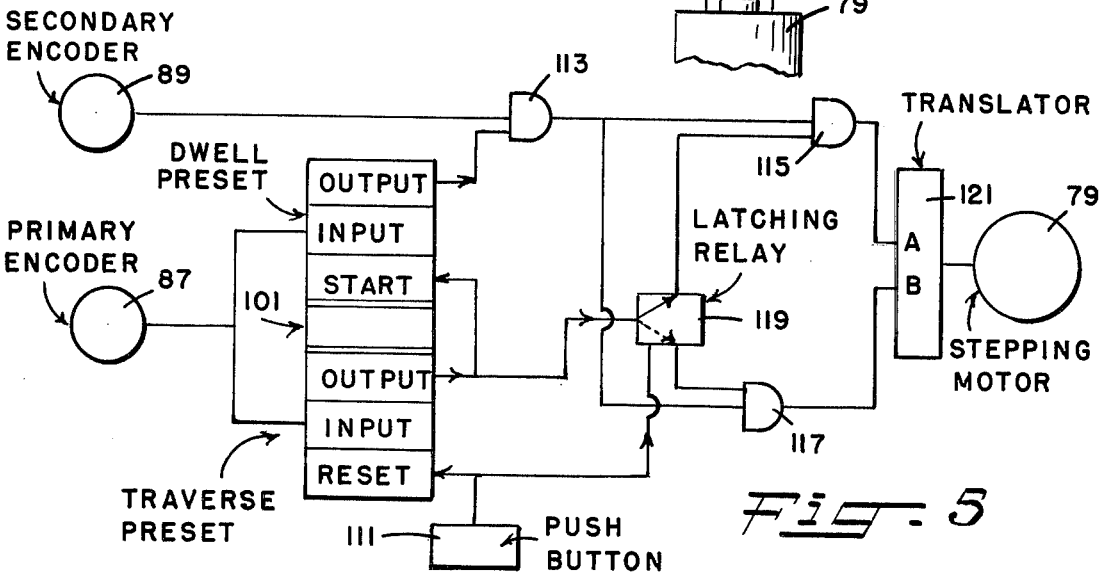
FIG. 5 is a wiring diagram of electronic means employed in the apparatus of this invention.

Referring now to FIG. 5, the electronic system employed includes the electronic counter 101 which has a dwell and a traverse preset. As heretofore mentioned, two electronic counters may be used instead of the single counter, having two presets, which is here described. This counter 101 is connected to an alternating current electrical source, through a push button 111 and receives pulses of electrical energy from the primary encoder 87. Output signals from the traverse preset of the counter 101 permit electrical pulses to flow from the secondary encoder 89 through a gate 113 and alternately through gates 115 and 117, as determined by a latching reverse relay 119, to a translator 121 and ultimately as stepping signals to the stepping motor 79. On the other hand, the dwell preset of the counter 101 prevents the flow of selected of such electrical pulses from the secondary encoder 89 beyond the gate 113.

More specifically, the presets of the electronic counter 101 are each adjusted or set for a different number of counts, with the output from the dwell or first preset serving to inhibit the flow of electrical pulses from the secondary encoder 89 beyond the gate 113. Thus, during the count of the dwell preset, the stepping motor 79 and, of course, the traverse screw 43 and carriage 45 remain stationary. Therefore, the count of this first preset determines the duration of dwell of the traverse carriage 45 at the end of each of its linear movements along the lead screw 43.

The traverse or second preset permits the translator 121 to receive from the secondary encoder 89 a predetermined number of pulses of electrical energy, although in the specific embodiment here described, it will count, but not transmit, that number of counts for which the dwell preset is adjusted. With each such pulse of electrical energy received by the translator 121 from the second encoder 89, the translator, in turn, delivers one stepping signal to the stepping motor 79 and will cause such motor 79 to be driven through a single step. The traverse lead screw 43, being coupled directly to the output shaft 83 of the motor 79, will therefore be turned as such motor 79 is driven to advance the traverse carriage 45 an incremental distance along its linear path. Obviously then, the total count of the traverse preset of the electronic counter must be such as to provide for the transmission of trains of stepping signals to the motor 79 which will advance the carriage 45 from one end of its desired linear path to the other plus the number of counts set into the dwell preset of such counter during which the carriage remains stationary.

More specifically, linear movement of the carriage 45 serves to traverse the strapping 29 simultaneously as such strapping is wound on the roll core. The linear distance through which such carriage 45 travels in each of its opposite directions determines the number of strapping turns or convolutions I + F in each overlapping layer of the roll being wound. This distance of carriage travel is dictated by the pitch of the traverse screw 43 and also by the number of counts set or entered into the traverse preset of the electronic counter and, since such preset number remains constant throughout the winding operation, each layer of the wound roll of strapping will consist of a like number of convolutions I + F.

Upon satisfying the number of counts of the traverse preset of the counter 101, a momentary signal is transmitted to the latching reverse relay 119 which prepares the system for rotating the motor 79 in its opposite direction during the next flow of pulses to the translator 121.

During each period of dwell of the carriage 45, a portion B of the strapping 29 which bridges overlying roll layers is wound onto the roll core. As noted above, the duration of these carriages dwell periods is such that the strapping portions F + B range from essentially $1 - \frac{7}{8}$ of a convolution to $1 + \frac{7}{8}$ convolutions and is determined by the number of counts set or entered into the dwell preset of the electronic counter 101. This preset number of counts should equal that number of electrical pulses generated by the primary encoder during rotation of the winding shaft 11 within the specified dwell range. For example, a dwell of 0.1, 0.5 or 0.75 turn, will provide bridging portions B of strapping which span arcs in the wound roll of 36°, 180° or 270° and, depending upon the value of F, adjacent of such bridging portions at the respective ends of the wound roll will be displaced circumferentially so as to provide two, three or four node groups at each of such ends.

As heretofore mentioned, overlapping of adjacent convolutions of strapping during the winding thereof is undesirable and is avoided with the apparatus of the present invention by conforming the linear rate of travel of the carriage 45 with the particular width of the strapping 29 which is being wound. This objective is satisfied by the change gear system 103 which, as heretofor described, consists of the gears 105 and 107 fixed to the shafts 91 and 93 of the primary and secondary encoders, respectively. Preferably, the system 103; that is, the ratio of the gears 105 and 107 is such as to advance the traverse carriage 45 a distance equal to the specified width of the strap 29, plus a spacing of from about 0.010 to 0.060 inch, during each revolution of the winding shaft 11.

It will be apparent that by varying the ratio of gears 105 and 107 of the change gear system 103, the number of electric pulses which are generated by the secondary encoder 89 during each revolution of the winding shaft 11 is changed but does not affect the output from the primary encoder 87. Such a variation in the change gear system will alter only the rate at which the stepping motor 79 advances the carriage 45 along the traverse screw 43, with the periods of carriage traverse and dwell remaining constant.

In practicing the method of the present invention with the apparatus described, the number of strapping convolutions wound on the core during traverse of the carriage in each of its opposite directions must be equal to I + F and the bridging portions B must be such that F + B range from essentially $1 - \frac{7}{8}$ of a convolution to $1 + \frac{7}{8}$ convolutions, with not less than two and not more than four node groups being formed at each end of the wound roll.

With a core of specified length, the actual number of strapping convolutions which can be wound in each roll layer of course, will depend upon the specified width of the strapping, and the spacing between adjacent of such strapping convolutions. Obviously, the lead of the traverse carriage; that is, the linear distance traversed by the carriage during such revolution of the winding shaft 11, must be greater than the specified width of the strapping which is to be wound to facilitate winding of such strapping with the adjacent convolutions thereof being spaced slightly from each other. The carriage lead thus serves as the basis for selecting a necessary combination of gears 105 (drive) and 107 (driven) of the system 103 and for determining the number of strapping convolutions I + F which can be wound onto a core of selected length. The latter information, in effect, defines the number of electrical pulses which must be delivered to the stepping motor 79 to achieve the necessary traverse of the carriage 45.

For a better understanding of the present invention, reference is made to the following Examples.

EXAMPLE I

In this Example, specific elements of the apparatus illustrated on the drawing and the conditions employed were, as follows:

Stepping Motor (79) — 0.9° step angle
Primary and Secondary Optical Encoders (87 and 89) — 400 output pulses/disc revolution
Traverse Screw — $\frac{1}{2}$ inch pitch
Specified Strapping Width — $\frac{3}{8}$ inch (0.375 inch)
Specified Core Length — about 6 inches
Carriage Dwell — $\frac{1}{2}$ revolution of winding shaft Under the above conditions, and as set forth in Table I, a variety of drive and driven gear combinations (105 and 107) could be employed, which provide for satisfactory spacing between adjacent strapping convolutions. Table I shows further the number of strapping convolutions which may be wound on the specified core during carriage traverse with the various gear combinations and, also, the calculated widths of the different wound rolls.

Strapping roll constructions which were considered to be best suited for a core having a length of about 6 inches are set forth in Table II, in which the calculated roll widths, as set forth in Table I, were increased by 0.06 inch to accommodate for roll expansion.

Having elected to produce a roll having a width of 5.83 inches, gears 105 and 107 having 83 and 102 teeth, respectively, were employed. As shown by Table II, such strapping roll had 13.25 convolutions of strapping, excluding that portion B which was wound during dwell, in each roll layer.

Insofar as the disk of the primary encoder 87 will generate 400 electrical pulses with each turn of the winding shaft 11, in winding the selected roll having a 5.83 inches width, the dwell preset of the electrical counter 101 was set for 200 counts to provide the desired $\frac{1}{2}$ turn dwell, during which the carriage 45 remained stationary while the winding shaft rotated through one-half of a revolution. Further, since 400 electrical pulses are generated by the primary encoder during each revolution of the winding shaft 11, the traverse preset of the counter 101 must permit the passage of 5300 electrical pulses from the secondary encoder to the translator 121 so that the stepping motor 79, and traverse carriage 45, are driven during the winding of the desired 13.25 convolutions of strapping. Actually, the traverse preset of the counter 101 was set for 5500 counts to include the 200 pulses set onto the dwell preset which was counted by but not transmitted from the traverse preset of such counter.

With a roll core 15 releasably fixed to the mandrel 9 on winding shaft 11, the strapping 29 was laced about the strapping guides 71, 69 and 73, after which its free end was taped to the roll core 15. When the push button 111 was actuated, the traverse preset of the counter 101 and the latching relay 119 are held in reset position until the motor 79 advances the carriage 45 to one end of its traverse stroke at which it strikes a limit switch 123. Such switch 123 is supported by the housing of the traverse mechanism 31 in the path of the carriage 45, at either or both ends of its linear travel, for actuating the counter start and, when engaged, rendered the dwell preset of the counter 101 operative.

The output pulses from the dwell preset were then delivered to the gate 13 which inhibited the flow of electrical pulses from the secondary encoder 89 until the 200 counts of this preset was completed. While this number of pulses was counted by the traverse preset of the counter 101, they were not transmitted from such preset. Thus, during this period, the carriage 45 was in a dwell position during which one-half of a strapping turn B was wound on the core 15. Subsequently the traverse preset of the counter 101 permitted 5300 output pulses to be transmitted from the secondary encoder 89, through one of the gates 115 and 117, to one of the translator terminals A and B. From the translator, 121 a train of 5300 stepping signals was delivered to the stepping motor 79. The output shaft of the stepping motor 79 and the traverse screw 43 to which it is coupled were thus rotated through 13.25 revolutions, causing the carriage 45 to move linearly until the I + F convolutions of 13.25 turns of strapping were wound on the core.

Once the traverse preset of the electronic counter 101 completed its count, a momentary signal was transmitted to the latching reverse relay 119 and prepared the other of such gates 115 and 117 for transmitting electrical pulses to the other of the translator terminals A and B after the dwell preset count was completed.

Thus, the cycle of the stepping motor is:

(1) inoperative during 200 counts;
(2) driving in one direction of rotation for 5300 counts;
(3) inoperative during 200 counts; and
(4) driving in its opposite direction of rotation for 5300 counts.

Figure 6:
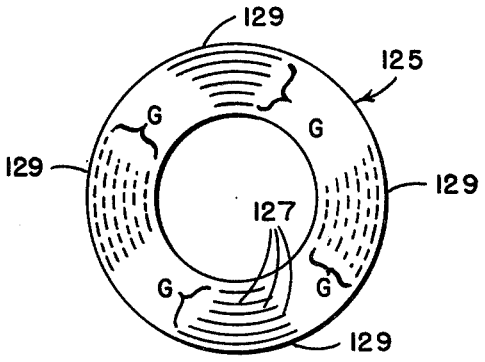
FIGS. 6 and 7 are end views of rolls of strapping wound in accordance with the teachings of the present invention.

The resulting roll 125 of strapping included a total of 13.75 strapping convolutions in each overlying layer; that is, with 13.25 convolutions (I + F) being wound during carriage traverse and a ½ convolution of strapping B being wound during carriage dwell. As viewed from its end, as shown in FIG. 6, the nodes or bands 127 formed by the bridging portions B of strapping which are wound during the carriage dwell, were arranged into two radially extending, diametrically aligned groups G.

With such grouping of nodes, the strapping roll had a slightly out-of-round cross-section at opposite ends thereof, with the areas indicated at 129 projecting above the remainder of the roll periphery. This relatively minor roll deformation was avoided in a subsequently wound roll simply by increasing the length of traverse; that is, with the original count of 5300 (5500 total) of the traverse preset if the counter 101 being increased by only one count to 5301 (5501 total). The ends of the resulting strapping roll, which had about a 3 inches thickness of wound strapping, exhibited a pattern as shown in FIG. 7 wherein the nodes or bands 131 were arranged in group G, but with the successive nodes of each such group being slightly displaced from each circumferentially in a clockwise direction.

Figure 7:
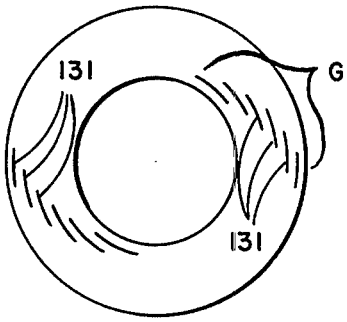

In lieu of increasing the count of the traverse preset, as described above, such count could have been reduced by one count, such as to 5299 (5499 total), to provide a strapping roll which differed from that shown in FIG. 7, only by having the nodes or bands of each group G displaced circumferentially in a counterclockwise direction relative to the roll axis.

Strapping rolls corresponding to those provided by increasing or decreasing the traverse count, as described above, could also have been formed by decreasing or increasing the count which is entered into the dwell preset of the counter 101. Thus, in the above Example, the dwell count could have been decreased or increased one dwell count, such as to 119 or to 201.

EXAMPLE II - XVI

In these Examples, specific elements of the apparatus illustrated on the drawing and the conditions employed were, as follows:

Stepping Motor (79) — 1.8° step angle
Primary and Secondary Optical Encoders (87 and 89) — 200 output pulses/disc revolution
Traverse Screw — ½ inch pitch
Specified Strapping Width — ⅜ inch (0.375 inch)
Specified Core length — about 6 inches
Drive Gear (105) — 83 teeth
Driven Gear (107) — 102 teeth The objectives of Examples II - XVI were to illustrate the effects on roll stability (push-outs) and strapping curvature with variations in dwell and traverse. Thus, while each roll layer consisted of the same number of strapping convolutions, only such number of convolutions were wound in each such layer as was necessary to satisfy the objectives. That is, no attempt was made to obtain the maximum number of strapping convolutions in each layer with the particular size core employed.

Table III and IV set forth the results achieved when the dwell and traverse were varied, yet satisfying the requirement that strapping portions F and B were together equal to ¼ convolution or 1¼ convolutions (Table III) and ¾ convolution or 1¾ convolutions (Table IV). In all of the Examples II - XVI, the strapping unwound from the roll was satisfactory for use with automatic strapping machines; that is, did not exhibit excessive curvature.

Although the wound rolls of strapping provided by Examples II - XVI were of acceptable stability, certain of such rolls exhibited a reduced tendency for push-outs to occur at the roll ends. Thus, based upon visual observations the wound rolls were rated on a scale from 1 to 5, in which the number rating increased with an increase in the tendency of the strapping to push-out from the roll end. For example, in a roll rated as "1" the ends of the wound roll were flat with essentially no node projections being observed. Ratings of from 2 to 5 indicate the presence of increasing numbers of node projections from the roll end. In all instances, the number of push-outs present at opposite ends of the respective rolls were essentially the same. Further, in all Examples II - XVI, two groups of nodes G were formed at each end of the wound roll, with such node groups being diametrically aligned; that is 180° apart, and the nodes at one end of the respective rolls were displaced 90° relative to the nodes at the opposite end of such individual rolls.

EXAMPLES XVII - XX

Using a 0.9° step angle stepping motor, primary and secondary optical encoders which generated 400 electrical pulses per disc revolution and drive and driven gears 105 and 107 having 57 and 113 teeth, respectively, strapping of 0.23 inch width was wound on a core with a spacing of 0.022 inch between adjacent convolutions. Table V illustrates additional winding conditions and the results achieved as the strapping portions F and B were varied, yet together provided a strapping portion of essentially ⅜ of a strapping convolution. Each of the wound rolls had three node groups at each end thereof and the stability of each such roll was rated on a scale of from 1 to 5, as in Example II - XVI.

Insofar as only a whole number of counts can be set on the counter presets, in each of Example XVII - XX the number of counts set into the traverse preset of the counter 101 was increased by a fraction of count to provide for a whole number of counts. For example, to achieve the winding of I and F convolutions of 11.5667 during the traverse of the carriage in one of its opposite directions would require that a count of 4626.680 be set into the traverse preset. Since this is not possible, the count was increased by 0.320 of a count and a whole number of 4627 was entered into the traverse preset of the counter. As a result, the nodes of each node group were arranged along a spiral path.

It is to be understood that changes and variations may be made without departing from the spirit and scope of the invention as defined in the appended claims.

TABLE II

| GEARS (Number of teeth) Drive | Driven | WIND Lead (inch) | Space (inch) | Traverse Turns (Number) | Count | Mamimum roll width (inches) |
|---|---|---|---|---|---|---|
| 87 | 100 | 0.4350 | 0.060 | 12.75 | 5100 | 5.98 |
| 83 | 100 | 0.4150 | 0.040 | 13.25 | 5300 | 5.93 |
| 87 | 102 | 0.4265 | 0.052 | 12.75 | 5100 | 5.87 |
| 83 | 102 | 0.4069 | 0.032 | 13.25 | 5300 | 5.83 |
| 87 | 100 | 0.4350 | 0.060 | 12.25 | 4900 | 5.76 |
| 83 | 100 | 0.4150 | 0.040 | 12.75 | 5100 | 5.73 |
| 87 | 102 | 0.4265 | 0.052 | 12.25 | 4900 | 5.66 |

$\frac{1}{8}$"STRAPPING
6" CORE WIDTH
0.9° STEP MOTOR

TABLE III

| EXAMPLE | TURNS/LAYER DWELL (B) | TRAVERSE (I+F) | TOTAL (I+F+B) | COUNTS DWELL | TRAVERSE | TOTAL | ROLL STABILITY EDGE PUSH-OUTS EVALUATION |
|---|---|---|---|---|---|---|---|
| II | 0.20 | 7.05 | 7.25 | 40 | 1410 | 1450 | 1 (Very Good) |
| III | 0.30 | 6.95 | 7.25 | 60 | 1390 | 1450 | 1 |
| IV | 0.40 | 6.85 | 7.25 | 80 | 1370 | 1450 | 2 |
| V | 0.50 | 6.75 | 7.25 | 100 | 1350 | 1450 | 3 |
| VI | 0.60 | 6.65 | 7.25 | 120 | 1330 | 1450 | 4 |
| VII | 0.70 | 6.55 | 7.25 | 140 | 1310 | 1450 | 4 |
| VIII | 0.80 | 6.45 | 7.25 | 160 | 1290 | 1450 | 5 (Very Poor) |

TABLE IV

| EXAMPLE | TURNS/LAYER DWELL (B) | TRAVERSE (I+F) | TOTAL (I+F+B) | COUNTS DWELL | TRAVERSE | TOTAL | ROLL STABILITY EDGE PUSH-OUTS EVALUATION |
|---|---|---|---|---|---|---|---|
| IX | 0.10 | 7.65 | 7.75 | 20 | 1530 | 1550 | 1 (Very Good) |
| X | 0.20 | 7.55 | 7.75 | 40 | 1510 | 1550 | 1 |
| XI | 0.30 | 7.45 | 7.75 | 60 | 1490 | 1550 | 1 |
| XII | 0.40 | 7.35 | 7.75 | 80 | 1470 | 1550 | 2 |
| XIII | 0.50 | 7.25 | 7.75 | 100 | 1450 | 1550 | 3 |
| XIV | 0.60 | 7.15 | 7.75 | 120 | 1430 | 1550 | 4 |
| XV | 0.70 | 7.05 | 7.75 | 140 | 1410 | 1550 | 4 |
| XVI | 0.80 | 6.95 | 7.75 | 160 | 1390 | 1550 | 5 (Very Poor) |

TABLE V

| EXAMPLE | TURNS/LAYER DWELL (B) | TRAVERSE (I+F) | TOTAL (I+F+B) | COUNTS DWELL | TRAVERSE | TOTAL | ROLL STABILITY EDGE PUSH-OUTS EVALUATION |
|---|---|---|---|---|---|---|---|
| XVII | 0.100 | 11.5667 | 11.6667 | 40 | 4627 | 4667 | 1 (Very Good) |
| XVIII | 0.200 | 11.4667 | 11.6667 | 80 | 4587 | 4667 | 2 |
| XIX | 0.333 | 11.3334 | 11.6667 | 133 | 4534 | 4667 | 2 |
| XX | 0.400 | 11.2667 | 11.6667 | 160 | 4507 | 4667 | 3 (Poor) |

What is claimed is:

1. A method of winding a continuous strapping as a roll comprised of a plurality of overlying layers each having a like number of strapping convolutions, said method including the steps of continuously advancing the strapping relative to a strapping traverse carriage toward and onto a continuously rotating shaft to wind the strapping thereon, moving the carriage linearly like distances in each of opposite directions relative and parallel to the rotating shaft and correlating the move-

TABLE I

| GEARS (Number of teeth) DRIVE | DRIVEN | WIND LEAD (inch) | SPACE (inch) | ROLL LAYER 12.25 | 13.25 | 14.25 | | ROLL LAYER 12.75 | 13.75 | |
|---|---|---|---|---|---|---|---|---|---|---|
| | | | | | | | Number of Convolutions (I + F) | | | Number of Convolutions (I + F) |
| 83 | 102 | 0.4069 | 0.032 | 5.36 | 5.77 | 6.17 | Roll Width (Strapping Width and Spacing-inches) | 5.56 | 5.97 | Roll Width (Strapping Width and Spacing - inches) |
| 83 | 100 | 0.4150 | 0.040 | 5.46 | 5.87 | 6.29 | | 5.67 | 6.08 | |
| 87 | 102 | 0.4265 | 0.052 | 5.60 | 6.03 | 6.45 | | 5.81 | 6.24 | |
| 87 | 100 | 0.4350 | 0.060 | 5.70 | 6.14 | 6.57 | | 5.92 | 6.36 | |

$\frac{1}{16}$" Strapping
6" Core Width ment of the traverse carriage with the rotation of the winding shaft by generating a like number of electrical pulses during each revolution of the winding shaft, employing a train of electrical pulses related to those generated during rotation of the winding shaft for moving the carriage in each of its opposite directions of traverse for a period during which I + F convolutions of strapping are wound about the shaft as a roll layer, where I is an interger and F ranges from zero to less than one complete convolution, and between successive movements of the carriage in the opposite directions of traverse maintaining the carriage in a dwell position for a period during which a selected number of such electrical pulses are generated by the rotation of the winding shaft and strapping portions B are wound on the roll which bridge overlying roll layers and define nodes at each of the roll ends, with the duration of each such dwell period being such that the strapping portions F and B together range essentially 1 minus $\frac{7}{8}$ of a strapping convolution to 1 plus $\frac{7}{8}$ strapping convolutions and the nodes defined by the bridging portions B at the respective ends of the wound roll are arranged in overlying relationships and form not less than 2 and not more than 4 groups of nodes at each of such roll ends.

2. A method as defined in claim 1 wherein the rate at which the carriage is moved in each of its directions of traverse is not less than the width of the strapping which is being wound per revolution of the winding shaft.

3. A method as defined in claim 1 wherein the carriage is maintained in dwell position for such duration that the strapping portions F and B are together equal to only $\frac{1}{4}$ or $\frac{3}{4}$ of a strapping convolution or $1\frac{1}{4}$ or $1\frac{3}{4}$ convolutions whereby the overlying nodes at the respective roll ends are arranged into only two diametrically aligned groups of nodes.

4. A method as defined in claim 1 wherein the carriage is maintained in dwell position for such duration that the strapping portions F and B together equal essentially $\frac{1}{3}$ or $\frac{2}{3}$ of a strapping convolution or $1\frac{1}{3}$ or $1\frac{2}{3}$ convolutions whereby nodes at the respective roll ends are arranged into only three groups of nodes.

5. A method as defined in claim 2 wherein the number of electrical pulses generated during the winding of the strapping portions F and B are together equal to essentially $\frac{1}{4}$, $\frac{3}{4}$, $1\frac{1}{4}$ or $1\frac{3}{4}$ times the number of electrical pulses generated during a complete revolution of the winding shaft whereby the overlying nodes at the respective roll ends are arranged in only two groups of nodes.

6. A method as defined in claim 4 wherein the number of electrical pulses generated during the winding of one of the strapping portions F and B is varied by less than one electrical pulse from that number of pulses which are required to provide strapping portions F and B that are together equal to only $\frac{1}{3}$ or $\frac{2}{3}$ of a strapping convolution or $1\frac{1}{3}$ or $1\frac{2}{3}$ convolutions, whereby the successive nodes in each node group are displaced circumferentially in the same direction relative to immediately preceding nodes of such group yet remain in overlying relationship and together lie along a spiral path.

7. A method as defined in claim 5 wherein the number of electrical pulses generated during the winding of the of the strapping portions F and B is varied by from 1 to 3 electrical pulses from that number of pulses which are required to provide strapping portions F and B that are together equal to only 174 or 182 of a strapping convolution or $1\frac{1}{4}$ or $1\frac{3}{4}$ convolutions, whereby the successive nodes in each node group are displaced circumferentially in the same direction relative to immediately preceding nodes of such group yet remain in overlying relationship and together lie along a spiral path.

8. A method as defined in claim 1 wherein the dwell periods are each equal to the minimum dwell for the particular strapping being wound.

9. A method as defined in claim 8 wherein the strapping being wound is formed of polypropylene in which the molecules thereof are aligned predominantly in the longitudinal direction of the strapping and wherein said minimum dwell period is equal to about 0.1 of a strapping convolution.

10. A method as defined in claim 1 wherein the strapping being wound is formed of polypropylene in which the molecules thereof are oriented predominantly in the longitudinal direction of the strapping and wherein the dwell periods are equal to from about 0.1 to 0.80 of a strapping convolution.

11. Apparatus for winding a continuous, longitudinally advancing strapping as a roll comprised of a plurality of overlying layers each having a like number of strapping convolutions, said apparatus including a winding shaft, means for continuously rotating said winding shaft, a traverse mechanism including a carriage for guiding the strapping during its longitudinal advancement toward said shaft, means including a stepping motor having an output shaft for reciprocating said carriage along a linear path substantially parallel to the axis of said winding shaft whereby the strapping is moved laterally relative to and concomitantly with its longitudinal advancement, and means for correlating said carriage reciprocating means with the rotation of said winding shaft, said correlating means including means for effecting intermittent operation of said stepping motor for like spaced periods, each such period of stepping motor operation effecting movement of said carriage in one direction of reciprocation during which I + F convolutions of strapping are wound about said shaft as a roll layer, where I is an interger and F ranges from zero to less than one complete convolution, and each interval between successive of such periods of operation serving to maintain said carriage in a dwell position during which a strapping portion B is wound on the roll which bridges overlying roll layers and defines a node at an end of such wound roll, with the duration of each such interval being such that strapping portions F and B range from essentially 1 minus $\frac{7}{8}$ of a strapping convolution to 1 plus $\frac{7}{8}$ strapping convolutions and the nodes defined by the bridging portions B at the respective ends of the wound roll are arranged in overlying relationship and form not less than 2 and not more than 4 groups of nodes.

12. Apparatus as defined in claim 11 wherein said carriage reciprocating means includes means effecting movment of said carriage linearly in each of its opposite directions at a rate not less than the width of the strapping which is being wound per each revolution of said winding shaft.

13. Apparatus as defined in claim 12 wherein said correlating means includes a primary encoder which generates a like number of electrical pulses during each revolution of said winding shaft and an electronic counter having two presets for receiving the electrical pulses generated by said primary encoder, one of said counter presets controlling the duration of the period of stepping motor operation and the other of said counter presets controlling the duration of the intervals between successive of such periods of stepping motor operation.

14. Apparatus as defined in claim 13 wherein said carriage reciprocating means includes a secondary encoder which is operatively connected with said primary encoder and which generates a like number of electrical pulses, related to that generated by said primary encoder, during each revolution of said winding shaft.

15. Apparatus as defined in claim 14, wherein said correlating means further includes a translator which is operatively connected with said secondary encoder and said stepping motor, said translator having terminals for receiving electrical pulses from said secondary encoder and serving to convert such pulses into trains of stepping signals which are transmitted to and operate said stepping motor.

16. Apparatus as defined in claim 15, wherein said correlating means further includes a reversing relay interposed between said secondary encoder and said translator and actuated by said one preset of said electronic counter for effecting the delivery of electric pulses from said secondary encoder alternately to different terminals of said translator to provide for rotation of said stepping motor in opposite direction thereof.

17. Apparatus as defined in claim 16, wherein said correlating means further includes an electrical switch interposed between said secondary encoder and said reversing relay, said switch being actuated by said other preset of said electronic counter for inhibiting the flow of electrical pulses from said secondary encoder to said translator.

18. Apparatus as defined in claim 14, wherein each of said primary and secondary encoders is an optical encoder having a rotatable shaft, wherein the means for effecting movement of said carriage at a rate not less than the width of the strapping which is being wound is a system of change gears including a drive gear fixed to the shaft of said primary encoder and driven gear fixed to the shaft of said secondary encoder, and wherein the shaft of said primary encoder is connected with and positively driven by said winding shaft.

19. Apparatus as defined in claim 17 wherein each of said primary and secondary encoders is an optical encoder having a rotatable shaft, wherein the means for effecting movement of said carriage at a rate not less than the width of the strapping which is being wound is a system of change gears including a drive gear fixed to the shaft of said primary encoder and driven gear fixed to the shaft of said secondary encoder, and wherein the shaft of said primary encoder is connected with and positively driven by said winding shaft.

20. A wound package of strapping comprised of a plurality of overlying layers of strapping, each of said layers having a like number of strapping convolutions including like portions which bridge overlying roll layers and which define nodes at the opposite ends of the wound roll at which the direction of the wind is reversed, said roll being characterized by having in each overlying layer thereof a like number of complete helical strapping convolutions together with a fraction of a convolution ranging from essentially $\frac{1}{8}$ to $\frac{7}{8}$ of a strapping convolution, the strapping convolutions in each of said layers being in non-overlapping relationship, the nodes defined by the bridging portions at the respective ends of the wound roll being arranged in overlying relationship and forming not less than two and not more than four groups of nodes at each of the roll ends and the successive nodes in the respective groups of nodes being displaced circumferentially in the same direction relative to an immediately preceding node of such group.

21. A wound package as defined in claim 20 wherein each overlying roll layer has a like number of complete strapping convolutions together with essentially one of $\frac{1}{4}$ or $\frac{3}{4}$ strapping convolution, and the overlying nodes of at the respective ends are arranged in only two groups of nodes.

22. A wound package as defined in claim 20 wherein each overlying roll layer has a like number of complete convolutions together with essentially one of $\frac{1}{3}$ or $\frac{2}{3}$ strapping convolution, and the overlying nodes at the respective ends are arranged in only three groups of nodes.

* * * * *

UNITED STATES PATENT AND TRADEMARK OFFICE

CERTIFICATE OF CORRECTION

PATENT NO. : 4,093,146

DATED : June 6, 1978

INVENTOR(S) : Harold A. Haley

It is certified that error appears in the above-identified patent and that said Letters Patent are hereby corrected as shown below:

Column 4, line 2, "convolutions" should read --convolutions"--. Column 5, line 19, "3/8 inches" should read --3/8"--; line 24, "portions" should read --portion--. Column 17, line 50, "3 inches" should read --3"--. Column 19, footnote beneath Table I, "1/16" Strapping" should read --3/8" Strapping--. Column 21, Claim 7, line 66, "174 or 182" should read --1/4 or 3/4--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademark*